United States Patent [19]

Zavacki

[11] Patent Number: 4,840,273

[45] Date of Patent: Jun. 20, 1989

[54] TOOL RETENTION DEVICE

[76] Inventor: Robert G. Zavacki, 4748 N. Kenneth, 2nd Flr., Chicago, Ill. 60630

[21] Appl. No.: 253,885

[22] Filed: Oct. 5, 1988

Related U.S. Application Data

[63] Continuation of Ser. No. 72,732, Jul. 13, 1987, abandoned.

[51] Int. Cl.[4] ..... B65D 85/28

[52] U.S. Cl. ..... 206/372; 206/373; 206/493; 220/23; 312/DIG. 33

[58] Field of Search ..... 206/349, 372, 373, 375, 206/376, 303, 493, 495, 553; 312/DIG. 33; 211/70.6, 70.7; 220/23

[56] References Cited

U.S. PATENT DOCUMENTS

| | | | |
|---|---|---|---|
| 665,012 | 1/1901 | Johnson | 211/70.6 |
| 925,244 | 6/1909 | Stevenson | 206/349 |
| 978,358 | 12/1910 | Colby | 206/373 |
| 1,405,422 | 2/1922 | Kennedy | 206/373 |
| 1,631,780 | 6/1927 | Zeitung | 206/373 |
| 1,657,854 | 1/1928 | Clemensen | 206/372 |
| 1,661,121 | 2/1928 | Huson | 206/372 |
| 1,933,894 | 11/1933 | Clink | 206/373 |
| 2,195,964 | 4/1940 | Hill | 211/70.6 |
| 2,308,533 | 1/1943 | Owen | 211/70.6 |
| 3,261,454 | 7/1966 | Elson et al. | 206/349 |
| 3,578,153 | 5/1971 | Olson | 220/23 |
| 3,878,939 | 4/1975 | Wilcox | 206/373 |
| 4,416,372 | 11/1983 | Polk | 312/DIG. 33 |
| 4,611,713 | 9/1986 | Byrns | 220/23 |

FOREIGN PATENT DOCUMENTS

| | | | |
|---|---|---|---|
| 176229 | 4/1917 | Canada | 206/349 |
| 354937 | 6/1922 | Fed. Rep. of Germany | 206/373 |
| 136203 | 2/1930 | Switzerland | 206/553 |
| 144962 | 4/1954 | Switzerland | 206/373 |
| 4635 | 10/1914 | United Kingdom | 206/373 |
| 504962 | 5/1939 | United Kingdom | 206/553 |
| 954608 | 4/1964 | United Kingdom | 206/553 |

*Primary Examiner*—David T. Fidei

[57] ABSTRACT

A device for retaining a tool within a tool box is disclosed which retains the tool in an efficient manner without occupying valuable space within the tool box itself. The device includes an elongated channel member which readily accepts and retains the tool and is affixed to an interior side of the tool box by conventional fastening means. A tool box having the device for retaining is also provided.

13 Claims, 1 Drawing Sheet

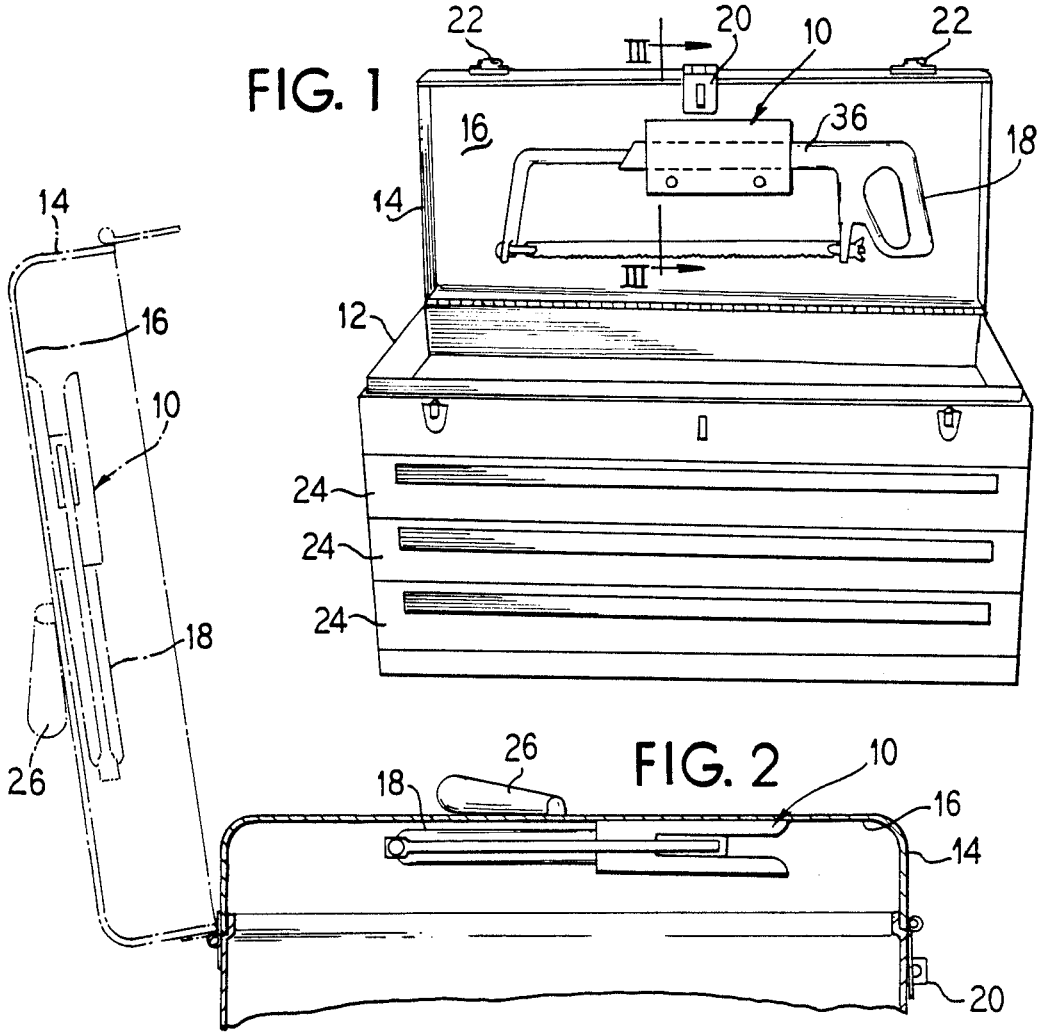
FIG. 1
FIG. 2
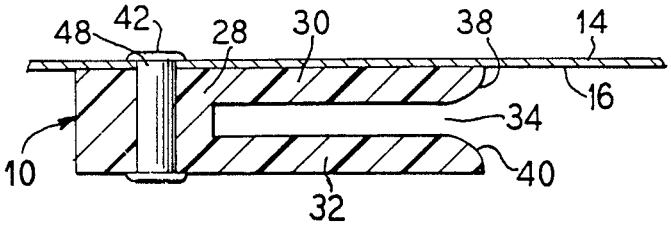
FIG. 3
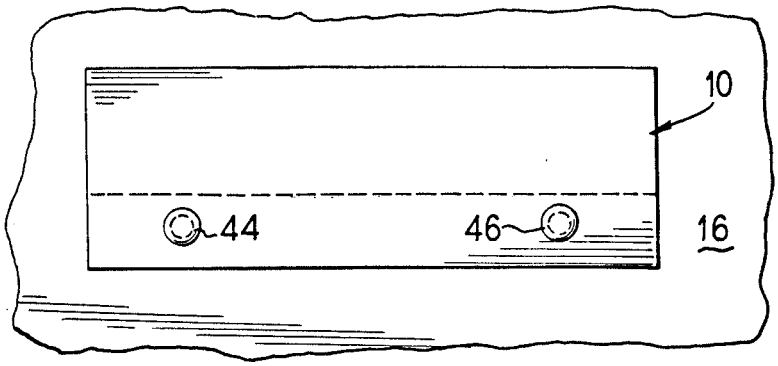
FIG. 4

TOOL RETENTION DEVICE

This is a continuation of application Ser. No. 072,732, filed July 13, 1987.

BACKGROUND OF THE INVENTION

The present invention relates to a device for retaining tools and similar items to a surface. More particularly, the present invention relates to a device for retaining a hacksaw or the like against the interior side of a tool box lid.

Tool boxes are well known in the art and range from simple boxes having a hinged lid to complex tool chests having numerous drawers and compartments. Typically, tool boxes do a fairly good job of housing most smaller tools and some provide additional trays or fixtures for holding tools in a desired, easy to get at arrangement. An example of such an additional tray would be a socket tray for a socket wrench set or a part tray for keeping small fasteners organized within the tool box itself.

Although these existing tool boxes readily accommodate smaller tools they do not readily store larger tools especially those having peculiar or bulky shapes. The problem of housing larger tools is especially acute during transportation of tool boxes. Since the tools are free to move around within the tool box during transport, disorder and possible tool damage can occur.

As used herein, the term "larger tools" includes, without limitation, saws, hacksaws, hammers, pliers, or like tools. Of course, these larger tools are typically standard in any tool collection and are frequently needed. Therefore, these tools must still be transported to most jobs and accordingly, these tools must be carried within the tool box or separately.

Accordingly, there is a need for a device which will retain such larger tools in an orderly fashion within a tool box without taking up an undue amount of tool box space.

SUMMARY OF THE INVENTION

The present invention provides a device for orderly retaining a tool, such as a hacksaw, within a tool box. The device comprises a fastening member having means for receiving the tool which is affixed to the interior side of a tool box lid. The fastening member is generally an elongated channel having a U-shaped cross-section with the distal ends of the channel walls being slightly beveled toward the interior of the device to facilitate easy insertion and removal of the tool.

When used to retain a hacksaw, the device of the present invention has a cross-section with a predetermined width which proximately corresponds to the dimensions of the bow-shaped frame of the hacksaw at its widest point.

In another embodiment, the present invention provides a tool box which comprises a lid, a plurality of drawers and a tool retention device affixed to the interior side of the lid. This tool box enables one to transport tools within the tool box in a secure, orderly manner.

Accordingly, the present invention provides a device for retaining a tool against the interior side of a tool box lid.

Another advantage of the present invention is to provide a device which will permit easy attachment and removal of the tool from the device.

An additional advantage of the present invention is that it provides a device which retains tools in an efficient manner and does not occupy valuable space within the tool box.

A further advantage of the device of the present invention is that it enables a user to quickly locate a desired tool when needed.

Another advantage of the device of the present invention is that it reduces tool damage and wear since the tool is securely stored and is not free to move around within the tool box during transportation.

Moreover, an advantage of the present invention is to provide a device which is inexpensive to manufactue, easy to install, lightweight, and does not require a lot of space or complex manipulation.

Additional features and advantages of the present invention are described in, and will be apparent from, the detailed description of the preferred embodiment and from the drawings.

BRIEF DESCRIPTION OF THE DRAWINGS

FIG. 1 is a front perspective view of the device of the present invention illustrated in conjunction with a tool box having its lid in an open position;

FIG. 2 is a left side view of the device of FIG. 1 illustrating both open and closed positions of the tool box lid;

FIG. 3 is a cross-sectional view of the device of FIG. 1, taken along lines III—III of FIG. 1 with the hacksaw removed;

FIG. 4 is a front plan view of the device of FIG. 1.

DESCRIPTION OF THE PREFERRED EMBODIMENTS

The principles of the present invention are incorporated in a retaining device generally indicated by numeral 10 in the drawings.

As FIG. 1 illustrates, the retaining device 10 is normally used in conjunction with a tool box 12 having a lid 14 and is preferably affixed to the interior side 16 of the lid 14 to retain a tool, such as, for example, a hacksaw 18. The tool box 12 illustrated in this embodiment is a well known type of tool box and includes a hasp assembly 20, two drawbolts 22, a plurality of drawers 24 and a handle 26. Of course, the device 10 of the present invention can be utilized with any tool box known in the art or any means for retaining and storing tools without departing from the teachings of the present invention.

The hacksaw 18 is a standard hacksaw which is common in the tool industry. Although the preferred embodiment of the present invention accommodates a hacksaw having a standard 12 inch cutting blade, it is to be noted that the device of the present invention may be used with virtually any size cutting blade. Moreover, as is well known in the tool industry, the upper frame of a standard hacksaw is composed of a thicker sleeve portion which accepts a thinner rod portion to provide adjustability of the hacksaw. Accordingly, the device of the present invention is designed in the preferred embodiment to fasten the hacksaw at its upper frame on the thicker sleeve portion which has standard dimensions throughout the industry. Alternatively, it is within the scope of the present invention to provide a device which may accept a hacksaw at its thinner rod portion, or any other part of the hacksaw. Likewise, the retaining device 10 of the present invention can be constructed to accept a different tool altogether.

Referring now to FIGS. 2, 3 and 4, the retaining device 10 is illustrated. The retaining device 10 is in the form of an elongated channel with a generally U-shaped cross-section having a base portion 28 and two upstanding leg members or walls 30 and 32. The retaining device 10 may be made from a variety of materials including metal or plastic, all of which will accomplish the desired results. The leg members 30 and 32 of the retaining device 10 are located at a predetermined distance from each other and define a slot or channel 34 whose width, preferably, corresponds to the width of the particular tool to be retained within the retaining device 10, e.g., a hacksaw. In the preferred embodiment, the width of slot 34 approximately equals the width of the bow-shaped frame member of the hacksaw 18 at its widest point, i.e., normally the thicker sleeve portion 36. Although in the preferred embodiment the width of slot 34 is approximately equal to or slightly greater than the width of bow-shape frame member 36, to form a tight fit, no discernable bending of the arm members 30 and 32 occurs. Alternatively, it is within the scope of the present invention to design arm members 30 and 32 with a slot 34 having a width somewhat smaller or larger than the width of a tool to be retained to obtain more of a force fit or loose fit respectively within the retaining device 10. If desired, the retaining device 10 can include some type of clasp means (not shown) near the distal ends 38 and 40 of arm members 30 and 32 respectively to further aid in retention of the tool.

The distal ends 38 and 40 of arm members 30 and 32 of the device 10, in the preferred embodiment illustrated, are beveled slightly inward toward the slot 34. This beveled design enables easier insertion of the hacksaw 18 within the retaining device 10.

As FIGS. 3 and 4 illustrate, the retaining device 10 is affixed to the interior side 16 of the lid 14 of the tool box 12 by a fastener 42. This fastener 42 may be any type of known conventional fastening member or an adhesive. In the preferred embodiment, the fastener 42 is a rivet which is inserted through apertures 44 and 46 of the retaining device 10 and then through apertures 48 of the lid 14 of the tool box 12. It should be noted that the material of the fasteners 42 as well as the number of fasteners 42 to be used can vary. Due to the length of the retaining device 10 in the preferred embodiment illustrated, two fasteners 42 are employed. Alternatively, only one fastener 42 may be necessary, especially if the length of the retaining device 10 is reduced.

The operation of the retaining device 10 is readily discernable from the drawings. When a tool such as a hacksaw 18 is to be mounted within the retaining device 10, the user merely opens the lid 14 of the tool box 12 to the open position, illustrated in FIGS. 1 and 2, and slides the widest part of the bow-shaped frame member 36 within the slot 34 of the retaining device 10. Thereafter, the lid 14 may be closed as illustrated in FIG. 2 whereby the hacksaw 18 will be retained within the retaining device 10 and the tool box 12 may be transported without the hacksaw 18 moving around within the tool box 12. For removal, the hacksaw 18 is merely removed from the retaining device 10 in the reverse order as described above.

It should be understood that various changes and modifications to the presently preferred emodiment described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. A tool box for removably securing a hacksaw within its interior comprising:

a lid movable from a first closed position to a second opened position; and a single unitary fastening member secured to the lid and having a channel that has a substantially U-shaped cross-section, the channel having a width, depth, and length, the width of the channel being such that it securely receives a portion of the hacksaw, the length, width, and depth of the channel being so constructed and arranged that the hacksaw is secured within the channel by merely being positioned therein regardless of whether the lid is in its first or second position without the need for additional fastening members.

2. The tool box of claim 1, wherein said elongated channel is defined by upstanding walls that are beveled toward the interior of said U-shaped fastening member.

3. The tool box of claim 1 wherein the fastening member is affixed to the lid by a rivet.

4. The tool box of claim 1, wherein the open end of said elongated channel faces upward with respect to the vertical when the lid is in the open position.

5. A device for removably securing a hacksaw, having a frame, to a movable portion of a tool box comprising:

a single unitary fastening member secured to the movable portion, said fastening member having a base section and first and second upstanding arm sections having proximal and distal ends extending away from said base section and a predetermined distance on the same side of said base section at the respective ends of said base section, said first and second arm sections defining a channel having a width, depth, and length, the channel having a substantially U-shaped cross-section formed by said base section and said first and second upstanding arm sections, the distal ends of the first and second arm sections are beveled toward one another, the width of the channel corresponding to a width of the frame of the hacksaw to be mounted allowing the hacksaw to be removably received within the channel, the first and second arm sections are separated from each other by a distance corresponding to the widest part of a bow-shaped frame portion of the hacksaw, the depth of the channel being at least equal to a height of the frame of the hacksaw to be mounted, and the length of the channel being sufficient to allow the hacksaw to be received within the channel and supported therein; and the width, depth, and height being so constructed and arranged that the hacksaw is secured within the channel during movement of the movable portion of the tool box merely by being received within the channel without the need for additional fastening means.

6. The device of claim 1, wherein said fastening means is a rivet.

7. The device of claim 5, wherein said fastening member is made of metal.

8. The device of claim 5, wherein said fastening member is made of plastic.

9. A device for removably securing a hacksaw, having a frame, to the interior side of a movable tool box lid comprising:

a first arm member having proximal and distal ends;

a base member having first and second ends, said first end being integrally formed to said proximal end of said first arm member, said base member being substantially perpendicular to said first arm member and having a predetermined length;

a second arm member having proximal and distal ends, said proximal end being integrally formed to said second end of said base member and extending substantially perpendicularly away from said base member in the same direction as and substantially parallel to said first arm member;

a channel formed between said first and second arm members, said channel having a width, depth and length, the width of the channel being slightly greater than the width of the frame of said hacksaw, the depth of the channel being greater than the height of the frame of said hacksaw and the length of the channel being greater than 50% of the length of the frame of said hacksaw; and the width, depth, and length of the channel being so constructed and arranged that the hacksaw can easily be inserted and removed from the channel and securely supported therein without the need for additional fastening members.

10. The device of claim 9 wherein said channel has a substantially U-shaped crosssection.

11. The device of claim 10, wherein said base member has at least one aperture for accepting said rivet means.

12. The device of claim 11, wherein said device is made of metal.

13. The device of claim 11, wherein said device is made of plastic.

* * * * *